United States Patent [19]

Gomoll et al.

[11] Patent Number: 4,789,258

[45] Date of Patent: Dec. 6, 1988

[54] PAPER FEEDING AND TRANSPORT THROUGH PRINTERS

[75] Inventors: Guenter Gomoll, Nersingen/Leibi; Wolfgang Hauslaib, Langenau, both of Fed. Rep. of Germany

[73] Assignee: Mannesmann AG, Duesseldorf, Fed. Rep. of Germany

[21] Appl. No.: 21,453

[22] Filed: Mar. 4, 1987

[30] Foreign Application Priority Data

Mar. 4, 1986 [DE] Fed. Rep. of Germany ..... 3607080

[51] Int. Cl.[4] ..... B41J 11/50

[52] U.S. Cl. ..... 400/605; 400/608.1; 271/9

[58] Field of Search ..... 400/605, 607, 607.2, 400/608.1, 608.2, 608.3, 608.4, 625, 616, 616.1, 616.3, 641; 271/9

[56] References Cited

U.S. PATENT DOCUMENTS

| | | | |
|---|---|---|---|
| 4,164,376 | 8/1979 | Yarp | 400/605 |
| 4,234,261 | 11/1980 | Hendrischk et al. | 400/608.3 |
| 4,391,542 | 7/1983 | Baitz | 400/625 |
| 4,522,382 | 6/1985 | Chu et al. | 271/9 X |
| 4,564,187 | 1/1986 | Costa et al. | 400/605 |
| 4,564,305 | 1/1987 | Rekewitz et al. | 400/605 |
| 4,579,471 | 4/1986 | Hendrischk | 400/605 |
| 4,688,957 | 8/1987 | Previgano | 400/605 |

FOREIGN PATENT DOCUMENTS

| | | | |
|---|---|---|---|
| 021453 | 2/1984 | European Pat. Off. . | |
| 2716396 | 10/1978 | Fed. Rep. of Germany | 400/605 |
| 3212988 | 11/1982 | Fed. Rep. of Germany | 400/605 |
| 205182 | 12/1982 | Japan | 400/605 |
| 131272 | 7/1984 | Japan | 400/607.2 |
| 12367 | 1/1986 | Japan | 400/605 |

*Primary Examiner*—Eugene H. Eickholt

*Attorney, Agent, or Firm*—Ralf H. Siegemund

[57] ABSTRACT

Multiple paper sources, including several single sheet channels and a tractor driven endless sheet channel, feed a common channel; the single sheets are friction roller driven upstream from the common channel. The common channel is curved and feeds past a flat platen off a downstream friction roller pair which however deflects the paper to hold it taut against the platen. The friction rollers and tractors are reversibly driven and the tractor is separately disconnected from the drive and through a sensor control sheets can be retracted from the platen.

19 Claims, 3 Drawing Sheets

PAPER FEEDING AND TRANSPORT THROUGH PRINTERS

BACKGROUND OF THE INVENTION

The present invention relates to the transport of paper into and through a printer, particularly a matrix printer, having a barshaped printing platen, and wherein separate feed channels are provided for single sheet feeding as well as for endless sheet feeding.

The feeding, particularly the single sheet feeding of paper into a printer operating in conjunction with a platen, usually involves friction rollers operating and being constructed in pairs. Also, endless sheet feeding is usually carried out by means of tractors, or the like, which grip, for example, perforations arranged along an endless sheet and pull the endless sheet through the printer.

In addition, it is also know to have sensors provided in printers of this type which sensors monitor absence or presence of sheet stock in various locations in the printer in order to control various functions within the printer.

The feeding of paper into the printer does not merely involve just particular standardized sheets or webs of paper but various formats, various paper thicknesses, and, particularly stacks or bundles of paper for multicopy printing, Leporello paper with and without edge perforation are also known. In accordance with one particular example, as shown, for example, in European patent application 99,958, corresponding to U.S. Pat. No. 4,579,471, paper is transported through sets of rollers, cooperating with a platen and arranged along the periphery of the platen roller. In addition, there is a brake provided in order to hold the paper against the platen. In accordance with another European patent application 99,957, corresponding to U.S. Patent application (Ser. No. 517,254, filed July 25, 1983), a second in line pressure roller set is provided for free-wheeling, and the platen roller itself can, in cases, be retracted slightly in order to avoid the formation of waves and slack in the paper. A taut i.e. tight abutment of the paper on the printing platen is necessary simply for the sake of clarity and precision of the characters being formed by the matrix printer. Also, the development of sound during printing will be reduced by taut positioning of the paper.

In accordance with newer experience, noise can be further attenuated through sound attenuation in the bearings for the printing platen, particularly if the platen is of bar-shaped, that is round in parts and non-circularly so. In particular, it was found in newer printers that it is of advantage to provide the platen with a flat and planar abutment surface against which printing obtains, as that will further improve the quality of printing. However, it can readily be seen that a platen with a flat printing surface changes basically the relationship as far as friction and adhesion is concerned as between the platen, on one hand, and the paper, on the other hand. There is no particular looping of the paper around the platen over a non-zero angle. This, in turn, means that in case one uses a printing platen with a planar printing surface, new elements have to be developed to still ensure lasting tight abutment of the paper against the platen, particularly during, as well as after threading paper into the printer.

DESCRIPTION OF THE INVENTION

It is an object of the present invention to improve the feeding and guiding of single sheets as well as endless sheets of different thicknesses, particularly under utilization of a printing platen with flat support surface so as to permit automated feeding in an interference and trouble-free manner.

In accordance with the preferred embodiment of the present invention, it is suggested to provide a feeder channel for feeder sheets with a first friction roller pair for feeding such individual sheets through the channel, and to provide a second feeder channel for endless sheets in conjunction with a tractor, both being arranged downstream from the printing process (platen) with a channel merger provided upstream from the printing platen; further features provide for reversible driving of the first mentioned friction roller pair and the tractor the latter being additionally selectively connected to the drive train. The combination of these features permit trouble-free changeover from single sheet feeding to endless sheet feeding or visa-versa, whereby in case a particular sheet, either from the endless sheet or from single sheet feeding, if partially advanced, can also be retracted. The inventive concept is based on the notion to provide a tractor as a pushing, rather than a pulling device and to shift the leading edge of whatever sheet is being fed, flat onto the flat surface of the printing platen.

In furtherance of the invention, it is suggested to provide, downstream from the printing area, an additional pulling paper transport device which is preferably constructed as a second friction roller pair. Full automatization of paper feeding is obtained in that in the direction of feeding, upstream from the first friction roller pair, a first paper presence sensor is provided, and a second paper sensor is provided behind the channel merger. The combination of sensor activator selects tractor operation specifically whether the tractor shaft is coupled to the drive and in which the drive is to run. The tractor for instance is decoupled while the first mentioned friction roller pair moves a single sheet into the feeder channel. Conversely the tractor may pull back the endless sheet prior to feeding of a single sheet towards the platen. In principle, the paper feeding can be vertically up or down; but, in fact, different directions of feedings can be selected. A particularly contoured platen carrier bounds the feeder channel for single sheets, and the feeder channel for the endless sheets includes channel plating guide elements for the paper; the common feeder channel includes another platen carrier surface and on the guide elements. This combination ensures that the paper can be deflected around a relatively sharp corner before being fed into the vertical up and past the platen. Owing to the tension in the paper, the deflection and a subsequent threading into the pulling downstream drive poses problems. These difficulties are avoided by including in the common feed channel a labyrinth-like structure which is established through a progressively concavely curved part of a paper guide, and a convexly projecting cam-like structure of, say, the printing platen carrier. This projection is somewhat receded from the abutment and printing surface plane of the printing platen proper. The progressively curved contour of the common feed channel bends the paper in such a manner that the bending is gradually reduced and the leading edge of the paper does, in fact, aim away from the proper feed position but in a capture range of the downstream rollers which will grip it and tension it taut across the platen in flat abutment against the flat and planar print surface of the platen. Tension bias in the sheet in longitudinal direction as well as transverse is obtained, in that this second friction roller pair is also slightly receded from that platen surface.

For obtaining the proper tension in the paper, the thickness of the different kinds of paper to be printed on, has to be considered also. Here then, one would chose a vertical tangent between the aforementioned projection and the point of actual gripping engagement with the second friction roller pair, establishing a gap with a vertical tangent that is inherent on the end of the concave paper guide sheet, and corresponds to a particular hypothetical paper thickness, whereby the common feeder channel tapers in paper feed direction.

As stated earlier, the tractor is provided for coupling and de-coupling to the drive. The purpose of this coupling unit is to couple a drive motor to a tractor shaft, by passing a permanent connection of that motor to the two friction roller pairs. A pinion with on the output shaft of that common drive motor meshes a worm gear, and motion for the rollers is taken from that gear by means of belts which in turn are respectively coupled to the friction roller pairs. The coupling is electronically controlled and includes a particular adjustment motor preferably being constructed as a step motor. The coupling's motion is carried out as follows. The intermediate gear is arranged rotatably on the tractor shaft. This intermediate gear is provided with a spline-like coupling, and a similar matching coupling part of a sleeve engages this spline-like intermediate gear. The sleeve rotates with the tractor shaft but is spring-biased and can axially move on the tractor shaft. This axial shift obtains through a cam structure cooperating with a lever. This lever may be adjusted manually or by the above mentioned step motor.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Figure 1:
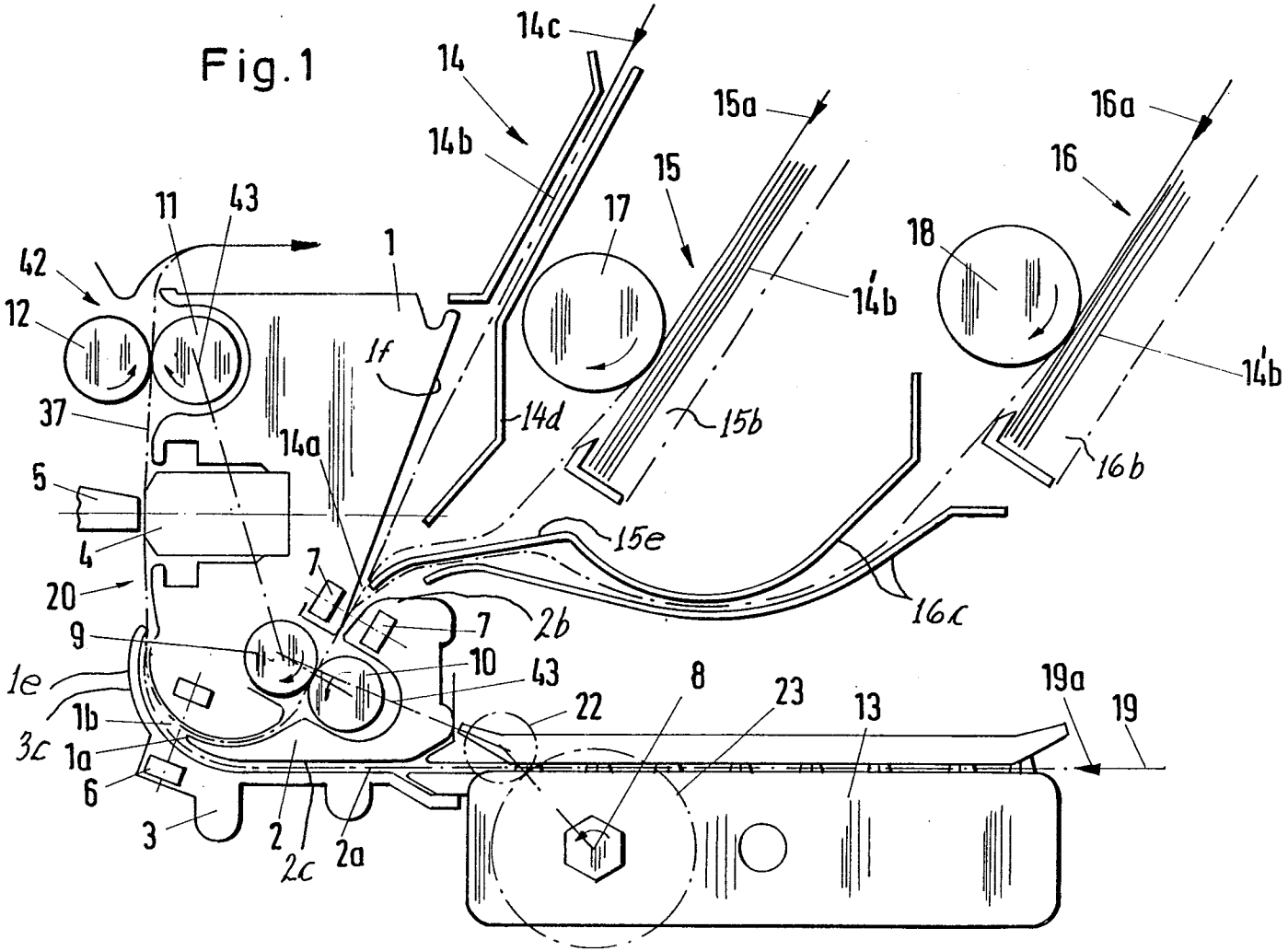
FIG. 1 is a cross-section through a printer showing essentially only those parts which are relevant for paper feeding, other parts are omitted, and are conventional; the feeding portion constituting an example of the preferred embodiment for practicing the best mode of the invention.

Proceeding now to the detailed description of the drawings, the paper transport, which constitutes the preferred embodiment of the present invention for practicing the best mode thereof, is explained in conjunction with a matrix printer which, however, is exemplatory only, and other printers can be used as well. The matrix printer includes a printing platen carrier 1 on which is mounted, and to which is fastened, a printing platen 4 proper. The platen 4 is sound attenuated, as disclosed, for example, in patent application Ser. No. 926,351, filed Oct. 31, 1986 (German printed patent application P 35 38 762 of Oct. 31, 1985). The platen 4 has a flat surface **4*a* and is juxtaposed to an ink ribbon on the other side of which is provided a print head 5. The distance is essentially determined by the paper thickness, a limiting factor being the stroke of the individual print elements in the print head 5**. That stroke length should be as small as possible for reasons of adequate print speed, which means that the gap between the print head and the platen should be as small as possible.

Reference numeral 14, generally, refers to a manual feed channel for single sheet feeding. Reference numeral 15 refers to a second feeding channel for automated single sheet feeding. Reference numeral 16 refers to another, or second, automated single sheet feeder channel, and reference numeral 13 is a tractor for endless sheet 19 feeding. All these channels merge in a common feeder channel **1*b*, but there is, so to speak, a pre-merging of the three channels 14,15,16 for single sheet feeding. This premerge channel is denoted with 14*a*. In between the merger point 14*a* of the single sheet feeding, and the merger with the endless sheet feeding there is provided a first friction roller pair, being comprised of rollers 9 and 10**.

This two-stage merger requires a certain contouring of channel parts and of the print platen carrier 1. The feeder channels 14, 15, and 16 and the common channel **14*a* for all of the single sheets that are being fed to the printer from various sources are provided as follows. The feeder channel 14 includes appropriate sheet structures establishing a slanted chute in the direction 14*c* for single sheet feeding. The chute has a slightly flared entrance to facilitate manual insertion of sheets such as 14*b*. This channel merges directly with a first automated single sheet feeder channel 15 which includes a tray 15*b* for stacks 14*b* of individual sheets 14*b*. These sheets are advanced by a drum 17 towards the merging zone 14*a* for all single sheet feeding. A suitable guide sheet 14*d* separates channels 14 and 15. Another guide sheet 15*e* establishes a second automated single sheet feeder channel 16, the feeding being in the direction 16*a*, there being a single sheet tray 16*b*. A drum 18 advances single sheets from this tray towards the merge point 14*a*** for all single sheet feeding.

The single sheet feeding is basically identified by the parallel, or substantially parallel, directions **14*c*, 15*a*, 16*a*, which, in fact, through appropriate deflection (14*d*,15*e*) merge all into the common channel 14*a*, being more or less the continuation of the channel 14. This channel as well as other feed channels 15 and 16 are approximately aligned but the feed channel 2*a* for the endless sheet 19, as well as the tractor 13, are oriented in a different direction. This different direction is identified by the arrow 19*a***, which identifies a horizontal path for the tractor advance for endless sheet feeding (pushing).

As stated, all these parts are arranged upstream from the common feed channel **1*a*. The common feeder channel for single sheet feeding extends from the merger point 14*a* to a common merger point 1*a* and includes, along that path, the first pair of friction rollers, including the rollers 9 and 10. This pair of rollers 9 and 10** is reversible, so is the drive for the tractor 13. In addition, the tractor can be turned on and off through the coupling unit 35 to be explained more fully below with reference to FIGS. 3, 4, and 5.

In addition to the foregoing the paper feed paths include a first paper guide element 2, and a second paper guide element 3. Between the two guide elements 2 and 3 extends a portion of the feeder channel for the endless sheet 19, and the guide element 2, so to speak, at its tip 1*a* establishes the merger point of all feeder channels into the common feeder channel 1*b*.

The basic objective of various parts including parts to be described, is to hold taut a flat sheet 37, being either a single sheet or the end portion of a continuous or endless sheet, against the print platen particularly its printing surface 4*a*. A pulling drive 42 is provided downstream from the flow of sheets, that is downstream from the head 5, as well as the platen 4. The pulling drive is comprised of a second pair of friction rollers 11 and 12. The merger point 1*a* for the sheet feeding is, of course, arranged upstream from the platen print head arrangement 4–5. A dynamic-kinematic linkage among the rollers 11/12 and 9/10 is disclosed in our copending application U.S. Ser. No. 02/454, filed Mar. 4, 1987 whose content is fully incorporated by reference in this application but is not essential to understand the present invention.

In addition to the various transporting devices, channels and guide sheets, there is provided a first paper sensor 7, being specifically positioned downstream from the single sheet merger channel 14*a* but upstream from the first pair of friction rollers 9–10 to, thereby, monitor whether or not a single sheet, regardless of its source (14 or 15 or 16), approaches this first pair of friction rollers. In addition, a second paper sensor 6 is provided downstream from the merger point 1*a* and in the common feed channel 1*b* and, thus, monitors whether or not any paper from any source is about to approach the printing area 4/5.

The above described arrangement operates as follows. The first paper sensor 7 may signal "no paper", which means, no single sheet is being fed to the printer for any of the sources 14,15,16. This state signal is electronically processed in circuit 100 for turning on tractor drive (21 in FIG. 3) so that the tractor 13 is turned on (the supplemental function of an additional tractor coupling clutch 35 will be discussed below). This way then, the paper from the endless sheet source is advanced by the tractor 13. If the first paper sensor 7 signals "paper present", then this presence signal is used by circuit 100 to monitor the state of paper sensor 6. If, at that point in time the sensor 7 has, in fact, not just signaled "paper present" but the leading edge of a single sheet has just passed, then a concurring (or the existing) "paper present" signal from sensor 6 causes the tractor 13 to reverse until sensor 6 signals "no paper", whereupon the tractor shaft 8 is decoupled from the tractor drive, and tractor 13 stops. The control now reverses the drive's direction of motion but the tractor reverses decoupled instead friction rollers 9,10 will again advance the one sheet. Previously, the friction rollers 9/10, also reversed and rejected the sheet that had just passed the sensors 7 (which gave rise to the retraction) but now the direction of motion is such that the friction roller pair 9–10 pulls the sheet from whatever source the single sheet comes un-impededly into the common feeder channel 1*b* when that single sheet passes 7 again, 6 positively signals "no paper". The subsequent passage of that sheet past the sensor 6 can at that point be used in 100 for other controls tasks such as "start printing" etc. which, however, has nothing to do with the invention.

Figure 2:
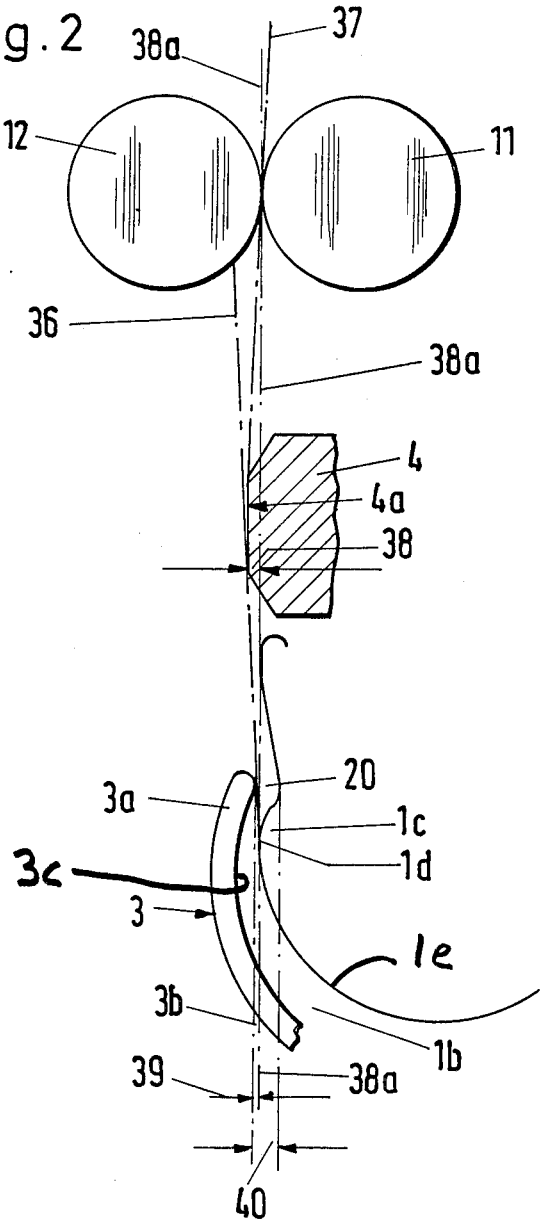
FIG. 2 illustrates in an enlarged scale certain details of the paper motion whenever it is being tensioned, and particularly in the area of a printing platen with a flat printing surface.

Next, we turn to features specifically relevant for the threading-in of single sheets or of an endless sheet 19, into the system. Considering first the single sheet feeding, it can be seen that the merger channel 14*a* for common single sheet feeding is established by a certain surface portion 1*f* and a surface 2*b* of the paper guide element 2. A different surface portion, namely 2*c*, of that element together with the second paper guide element 3 being, so to speak, a platform continuation of the tractor, establishes the endless sheet feeder channel 2*a*. The common feeder channel 1*b* for all types of paper is specifically established by a curved portion 1*e* of the platen carrier 1, and of a partly curved portion 3*c* of the paper guide element 3 (see also FIG. 3). It is important that the common channel 16 of the single sheet feeder channel and particularly of the endless sheet feeder channel the second paper guide element 3 establishes a deflection of paper which, as far as the endless sheets are concerned, is generally a deflection of roughly 90 degrees, while, owing to the space requirements, a single sheet feeding is deflected by roughly 150 degrees. As illustrated on a larger scale, and in greater detail in FIG. 2, the common feeder channel 1*b* feeds a labyrinth 20 which is comprised of the progressively curved part 3*a* of the paper guide element 3, and of a cam portion 1*c* of the platen carrier 1. The furthermost projection surface 1*d* of the carrier 1, as shown in FIG. 2, does not quite reach the plane established by the surface 4*a* of printing platen 4. Moreover, the contact point of paper (right at that furthermost projection - vertical tanget 38*a*) is separated by a distance 38 from that vertical tangent 38*a*. The tangent 38*a* on the surface 1*d*, so to speak, gives in the horizontal the furthermost point of lateral deflection of the sheet 37 that is being fed to the printing area. The distance 38 is indicative of the distance (deflection) the generally vertically fed sheet has to undergo to reach the printing platen surface 4*a*.

The aforementioned geometry, moreover, leads to a continuous narrowing of the common feeder channel 1*b* which, however, is limited. A flat abutment of a single sheet 14*b* or of the endless sheet 19 against the platen, moreover, is obtained through a companion lateral displacement of the second friction roller pair 11 and 12 by about the same distance 38 from the print platen 4. In other words, tangent 38*a* runs through the abutment plane of the two rollers 11 and 12. One can also say, therefore, that the point of engagement of a sheet by the friction roller pairs 11 and 12, and the run-off point 1*d*', at which point the sheet leaves the feeder channel 1*b*, are vertically aligned, and the distance 38 denotes a lateral deflection of the paper by the print surface 4*a* out of that vertical plane.

The general narrowing of the common feeder channel 1*b* is limited by the operation of the vertical 38*a*, extending specifically between the cam projection 1*c* and the point of engagement of the sheet with the second friction roller pair 11 and 12. A vertical tangent 3*b* on the end or tip of the second paper guide element 3 establishes with that limiting plane and together with tangent 38*a* a hypothetical paper sheet thickness limiting gap 39 is established. The common feeder channel 1*b* is, therefore, limited in paper feed direction by that gap 39. The maximal actual or true paper thickness is denoted by reference numeral 40. This paper thickness 40 is given by the maximum permissible number of superimposed sheets of given thickness, as well as by the type of marginal perforation edge of the paper that is being used. The labyrinth 20 narrows the common feeder channel 1*b* down to the gap 39. A single sheet 14*b* or the endless sheet 19, having a leading edge 36, is guided by the end of that channel 1*b* almost into the vertical, and will, without problems, engage and gripped by the friction roller 12, will be deflected and will, thereafter, be held taut by the rollers 11/12 above and onto the print surface 4*a*. Whether or not there is, in fact, a true single sheet or a bundle of sheets, and whether or not there are of more stiff perforations, makes very little difference, so that the labyrinth 20 is constructed to take up these problems.

Figure 3:
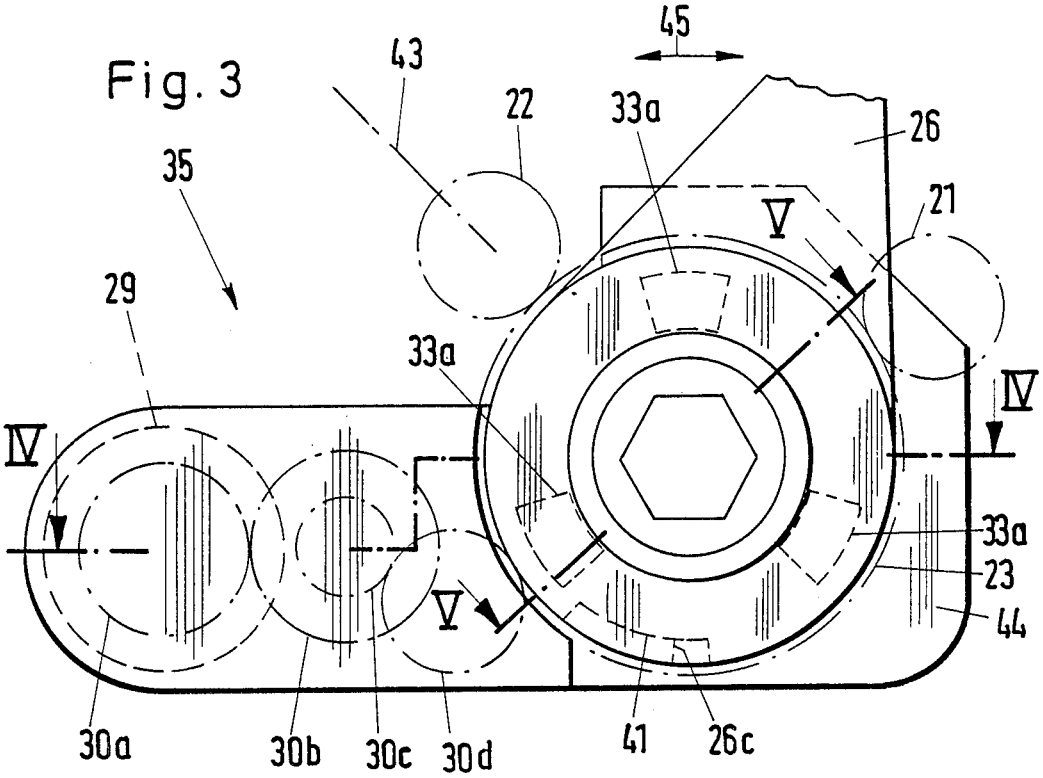
FIG. 3 is a side view of a coupling unit for the tractor used in the device shown in FIGS. 1 and 2.
Figure 4:
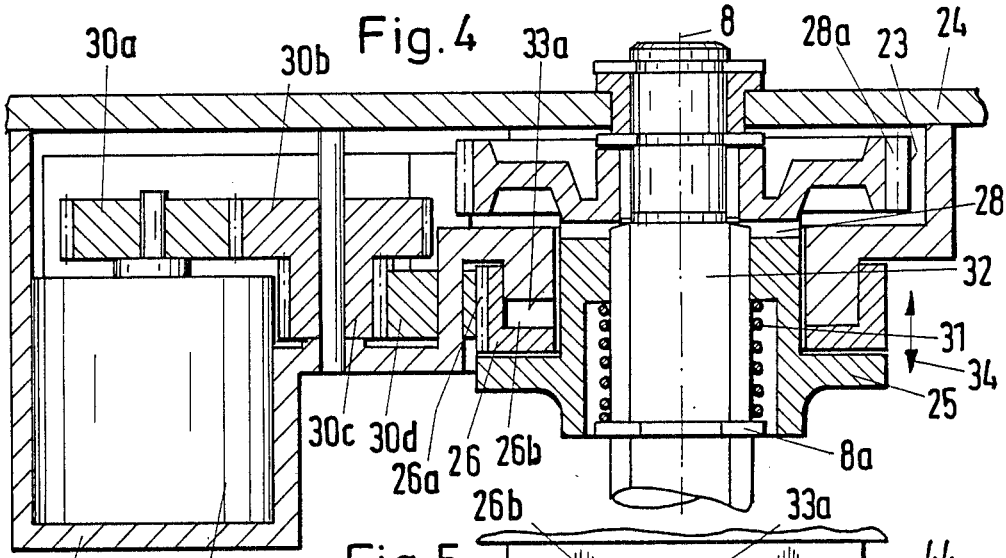
FIG. 4 is a cross-section through the line IV—IV in FIG. 3.
Figure 5:
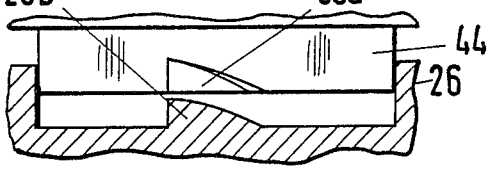
FIG. 5 is a cross-section through the coupling unit as shown by V—V in FIG. 3.

Proceeding now to the description of details of the coupling unit 35, we refer specifically to the FIGS. 3, 4, and 5. The coupling unit includes a motor shaft pinion 21*a*, which meshes an intermediate gear 23, and, thereby, drives the tractor shaft 8, as well as a worm gear 22. The drive force received by the gear 22 is imparted upon a plurality of belts 43 which in turn drive all of the friction rollers 9, 10, 11, and 12. Pinion 21*a* is driven by the motor 21. The pinion 21*a*, however, is, in addition, associated with an adjusting motor 29, secured to a housing 44 off the main frame or side wall 14 of the printer which receives a drive train, including a motor drive pinion 30*a*, a gear 30*b* and meshing therewith, the stepped down gear 30*c* and 30*b*, and an intermediate gear 30*d*. The intermediate gear 30*d* engages a gearing 26*a* of a coupling lever 26, which can be operated manually or through the adjusting motor 29. A coupling sleeve 25 is provided with an axial coupling spline 28, and the gear 23 is provided with a corresponding axial spline 28*a*. The tractor shaft 8 is provided with a hex shaped key shaft 32. Depending upon the direction of motion 34 (double arrow) the tractor 13 is driven or not. The direction of motion is determined by a cam structure 37*a* and 26*b*; the cam structure 37*a* is part of the housing 44, and the cam 26*b* extending axially from lever 26 (see FIG. 5). The axial motion (displacement) imparted by the cam interaction must be larger than the height of the gears of the spline gearing 28*a*. There are all together three cams 38*a* and three cams 26*b*; they are separated by about 120 degrees, as shown in FIG. 3. The coupling sleeve 25 will normally be kept in engagement with gear 23 by means of a spring 31, which acts against a collar 8*a* of the tractor shaft 8 (FIG. 4). Engagement is, of course, as between the gearing 28 and 28*a*, so that the coupling unit 35 is, in this case of engagement, operated as a tractor drive. However, on turning disk 26 by means of motor 29 (or manually) lugs 26*b* slip out of indents 33*a* (FIG. 5) and that pushes the lever 26 axially such that sleeve 25 tensions spring 31 and the splines 28/28*a* disengage. The pivot motion of the lever 26 in the direction 45 is limited by the element 41 on casing 44, and by a cooperating pin 26*c* extending from lever-disk 26.

The invention is not limited to the embodiments described above, but all changes and modifications thereof, not constituting departures from the spirit and scope of the invention are intended to be included.

We claim:

1. In a printer having a bar-shaped printing platen with flat printing surface, a device for feeding individual sheets, as well as endless sheets, to a print position adjacent to the platen, comprising in combination:

a first feeder channel for single sheets, including a first pair of friction rollers for transporting the individual sheets towards said platen;

a second feeder channel for endless sheets, including a sheet engaging tractor arranged to bypass said first friction roller pair, and also feeding said endless sheet towards said printing platen, there being a common channel and a merger point and area for feeder paths into which, respectively, either a single sheet or an endless sheet are to be fed;

means for reversibly driving said first pair of friction rollers;

means for reversibly driving said tractor; and means for selectively connecting and disconnecting said tractor from its means for driving said tractor.

2. Paper feed device as in claim 1, there being a sheet pulling drive arranged downstream from said printing platen.

3. The improvement as in claim 2, said pulling drive being provided by a second pair of friction rollers.

4. The improvement as in claim 1, there being first a "paper present" sensor provided upstream from said first roller pair, there being a second paper sensor provided downstream from said point and area of merging; there being means connected to said first and second sensors for controlling a sequence of driving said first friction roller pair and said tractor to prevent conflict of paper in said merging area and point.

5. The improvement as in claim 1, wherein said common merger point and area is situated in areas of curving of respective feeder paths for the single sheet and the endless sheet.

6. The improvement as in claim 5, wherein at least one of the feeder path is deflected from the horizontal generally into the vertical.

7. The improvement as in claim 1, wherein said common channel includes a progressively curving channel portion feeding said sheets into a vertical path, said printing platen surface being slightly laterally displaced from said vertical path so as to laterally deflect the fed sheet from a true vertical path.

8. The improvement as in claim 7, there being a second pair of friction rollers disposed downstream from the platen for capturing a sheet and holding it taut against the platen.

9. In a printer having a bar-shaped printing platen with flat printing surface, a device for feeding individual sheets, as well as endless sheets, to a print position adjacent to the platen, comprising in combination:

a first feeder channel for single sheets, including a first pair of friction rollers for transporting the individual sheets towards said platen;

a second feeder channel for endless sheets, including a sheet engaging tractor arranged to bypass said first friction roller pair, and also feeding said endless sheet towards said printing platen;

a third, curved feeder channel into which the first and second channels merge, said third feeder channel feeding paper into a particular vertical or near vertical direction towards said platen; and a second pair of friction rollers arranged such that upon engagement with paper as emerging from the third channel, the paper is held by the platen by providing a slight lateral deflection.

10. The improvement as in claim 9, said third feeder channel having a first concavely curved part, there being a second convexly shaped part, the third feeder channel being established between these parts, the convexly shaped part projecting laterally less than said platen.

11. The improvement as in claim 10, said second pair of friction rollers being aligned with said convexly shaped part.

12. The improvement as in claim 11, said alignment forming a minimal hypothetical gap with an end of the concavely shaped part thereby effectively narrowing the end of the third feeder channel.

13. In a printer having a bar-shaped printing platen with flat printing surface, a device for feeding individual sheets, as well as endless sheets, to a print position adjacent to the platen, comprising in combination:

a first feeder channel for single sheets, including a first pair of friction rollers for transporting the individual sheets towards said platen;

a second feeder channel for endless sheets, including a sheet engaging tractor having a shaft and being arranged to bypass said first friction roller pair, and also feeding said endless sheet towards said printing platen, there being a merger channel into which either a single sheet or an endless sheet are being fed;

means for reversibly driving said first pair of friction rollers;

a means for reversibly driving said tractor;

a second pair of friction rollers downstream from the platen;

second means for reversibly driving the first and second pairs of friction rollers and the tractor; and coupling means for causing the means for driving the tractor to selectively engage with and disengage from the tractor.

14. The improvement as in claim 13 and including an adjusting motor connected for operating the coupling means.

15. The improvement as in claim 14 including paper present sensor means operating upon single sheet feeding for causing the tractor drive means to reverse the adjusting motor to operate the coupling means.

16. The improvement as in claim 14, the coupling means being an axially spring biased sleeve on the tractor shaft and being axially shifted on turning of the adjusting motor to cause the sleeve and the tractor shaft to be coupled to a gear driven by the means for driving the tractor, there being means connected to the gear for driving the rollers.

17. The improvement as in claim 16, the coupling means including an axially slidable disk driven by the adjusting motor to be axially shifted between a sleeve displacing position and a locked position.

18. The improvement as in claim 17, the adjusting motor being a step motor.

19. The improvement as in claim 16, there being drive means coupled to the gear for driving the friction rollers.

* * * * *